United States Patent [19]

Palmisano

[11] Patent Number: 4,719,714

[45] Date of Patent: Jan. 19, 1988

[54] LOCKING LUG INSERT FOR A FIREARM RECEIVER

[76] Inventor: Louis Palmisano, 627 E. 24th St., Paterson, N.J. 07505

[21] Appl. No.: 875,999

[22] Filed: Jun. 19, 1986

[51] Int. Cl.[4] ..... F41C 7/00

[52] U.S. Cl. ..... 42/16; 42/25

[58] Field of Search ..... 42/16, 25

[56] References Cited

U.S. PATENT DOCUMENTS

| | | | |
|---|---|---|---|
| 921,042 | 5/1909 | Williams | 72/199 |
| 2,139,648 | 12/1938 | Chambers | 42/16 |
| 3,027,672 | 4/1962 | Sullivan | 42/16 |
| 3,260,542 | 7/1966 | Di Milla | 403/356 |
| 3,710,492 | 1/1973 | Tirrell | 42/16 |
| 4,402,152 | 9/1983 | Casull | 42/16 |
| 4,454,672 | 6/1984 | Timari | 42/16 |
| 4,547,988 | 10/1985 | Nilsson | 42/16 |

*Primary Examiner*—Deborah L. Kyle
*Assistant Examiner*—Michael J. Carone
*Attorney, Agent, or Firm*—Bacon & Thomas

[57] ABSTRACT

The present invention relates to a locking lug insert which is inserted into the locking lug recess of a bolt action receiver. The insert defines a central aperture aligned with an elongated chamber in the receiver and one or more cut-out portions opening into the central aperture, one cut-out aligned with each locking lug groove. The cut-out portions are equal in number to the number of locking lug grooves formed in the receiver. The cut-out portions are sized so as to accommodate the locking lugs of the bolt when the bolt is in its closed position. The insert is caused to rotate in the locking lug recess when the bolt rotates, due to the interengagement of the locking lugs, with the cut-out portions.

22 Claims, 7 Drawing Figures

4,719,714

LOCKING LUG INSERT FOR A FIREARM RECEIVER

FIELD OF THE INVENTION

The present invention relates to an insert rotatably mounted within a locking lug recess of a firearm receiver.

BRIEF DESCRIPTION OF THE PRIOR ART

Firearm bolt actions are well known in the art and typically comprise a receiver defining an elongated chamber and a bolt slidably received within the chamber. The bolt has one or more lugs radially extending therefrom adjacent one end, which lugs slidably engage one or more elongated locking lug grooves formed in the receiver. This allows the bolt to slide with respect to the receiver between an open position, wherein a cartridge may be inserted into the receiver, and a closed position wherein the bolt forces the cartridge into a firing chamber. In order to lock the bolt in the closed position, the receiver also defines an annular locking lug recess extending around the periphery of the elongated chamber and dimensioned so as to accommodate the locking lug when the bolt is in the closed position. This allows the bolt to be rotated through a given angle to thereby move the locking lug out of alignment with the locking lug groove formed in the receiver. When in this position, the engagement of the locking lug with the locking lug recess prevents any movement of the bolt with respect to the receiver, including posterior sliding movement along the operating plane of the bolt.

The receiver and the bolt are machined to close tolerances, but clearances must be provided to permit the sliding and rotational movement of the bolt with respect to the receiver. Debris accumulating within the locking lug recess may render the proper locking of the bolt difficult, if not impossible. Also, the clearances between the bolt and the receiver and the former empty space around the bolt face may allow the rearward escape of gasses from a cartridge should the cartridge rupture during firing.

While it is known to provide a gas shield or baffle on the bolt to the rear of the locking lugs, such a shield or baffle does not prevent the accumulation of debris in the locking recess and will not prevent jamming of the bolt due to the presence of such debris.

SUMMARY OF THE INVENTION

The present invention relates to a locking lug insert which is inserted into the locking lug recess of the receiver. The insert defines a central aperture aligned with the elongated chamber in the receiver and one or more cut-out portions opening into the central aperture, one cut-out aligned with each locking lug groove. The cut-out portions are equal in number to the number of locking lug grooves formed in the receiver. The cut-out portions are sized so as to accommodate the locking lugs of the bolt when the bolt is in any position. The insert is caused to rotate in the locking lug recess when the bolt rotates, due to the interengagement of the locking lugs, with the cut-out portions.

The insert may be formed of a low-friction plastic, nylon or metal, or combinations of both, impregnated with Teflon or graphite material such that it will keep the locking lug recess free of any accumulated debris and will facilitate the rotation of the bolt with respect to the receiver. The insert will also prevent the backward escape of gasses due to a cartridge rupture and will also provide a dampening effect to barrel vibrations. The insert will also protect the tip of the bullet from any deformation as it is advancing through the receiver into the firing chamber. It also makes it unnecessary to use lubricant in the locking lug recess, which may freeze the bolt closed in sub-zero temperatures.

DETAILED DESCRIPTION OF THE PREFERRED EMBODIMENT

Figure 1:
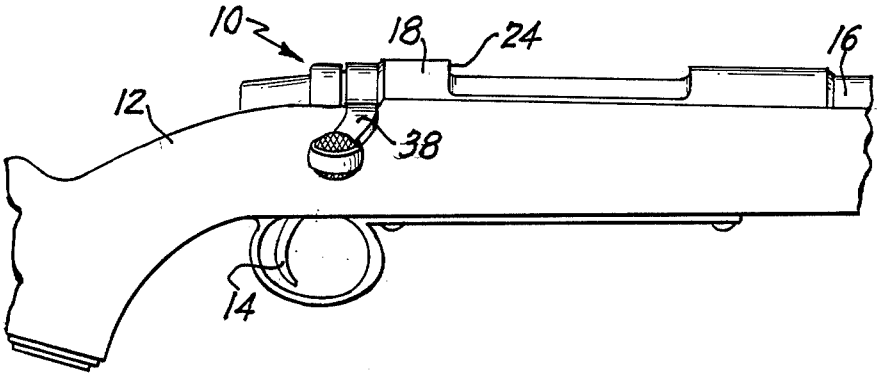
FIG. 1 is a partial side elevational view showing a firearm incorporating the bolt action according to the invention.
Figure 7:
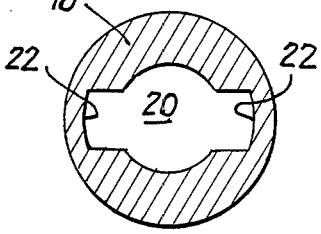
FIG. 7 is a cross-sectional view taken along lines 7—7 in FIG. 2, showing the receiver with the bolt removed.

FIG. 1 illustrates a bolt action 10 attached to rifle stock 12 and associated with known trigger mechanism 14 and barrel 16. As shown in more detail in FIGS. 2 and 7, bolt action 10 comprises a receiver 18 which defines a longitudinally extending, elongated chamber 20. Receiver 18 also defines a pair of longitudinally extending locking lug grooves 22 located on either side of, and opening into, chamber 20. Although the invention will be described in relation to a receiver having a pair of such locking lug grooves, it is to be understood that a receiver having more or less than two such grooves can be utilized without exceeding the scope of this invention. The outer wall of receiver 18 defines an opening 24 which communicates with the elongated chamber 20 to facilitate the insertion and removal of a cartridge into the chamber 20.

Receiver 18 also defines an annular locking lug recess 26 which extends around the periphery, and opens into, elongated chamber 20. Locking lug recess 26 is located adjacent end 18A of the receiver which is connected to an end of barrel 16 via threads 28.

Figure 2:
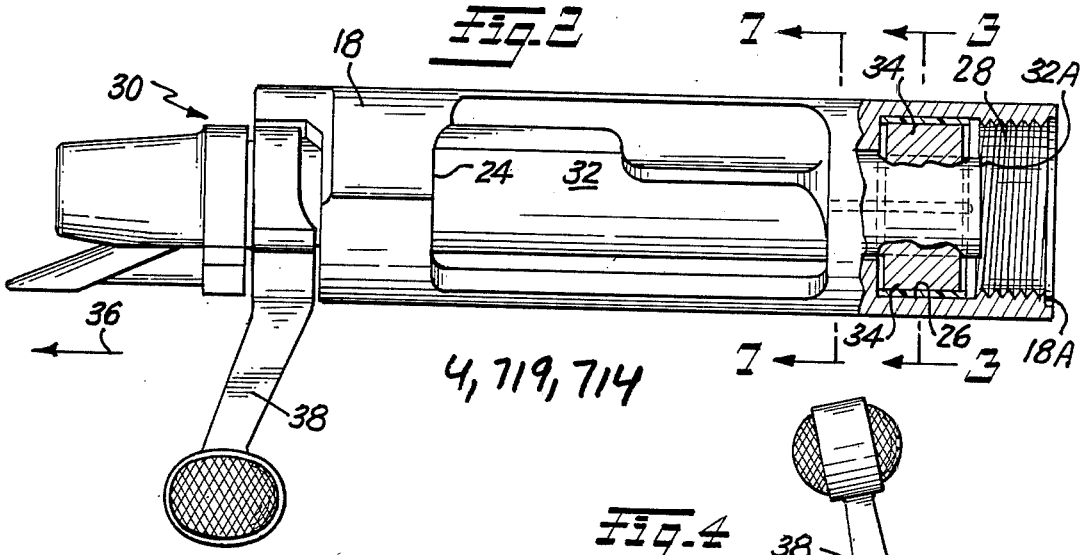
FIG. 2 is a plan view of the bolt action, partially in section, according to the invention.

Bolt 30 has elongated, cylindrical portion 32 extending into elongated chamber 20. Bolt 30 has a pair of radially extending locking lugs 34 located adjacent end 32A. Although two oppositely extending locking lugs 34 are utilized for illustrative purposes, it should be understood that the number of locking lugs will be equal to the number of elongated locking grooves formed in the receiver. The length of elongated bolt portion 32 is such that locking lugs 34 are aligned with the annular locking recess 26 when bolt 30 is in its closed position, as illustrated in FIGS. 1 and 2. When bolt 30 is in its closed position wherein locking lugs 34 are aligned with elongated locking grooves 22, bolt 30 may be moved in the direction of arrow 36 posteriorly with respect to receiver 18, as shown in FIG. 2. Thus, by sliding bolt 30 to the left as seen in FIG. 2, to its opened position wherein end 32A is located to the left of opening 24, it is possible to insert a cartridge into a chamber 20 or to remove a spent cartridge therefrom. By sliding bolt 30 to the right, as seen in FIG. 2, to its closed position, a cartridge in chamber 20 is forced into a firing chamber (not shown).

Figure 3:
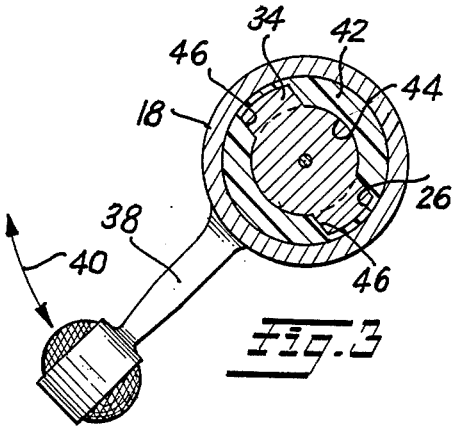
FIG. 3 is a cross-sectional view taken along line 3—3 in FIG. 2 showing the bolt rotated into its locked position.
Figure 4:
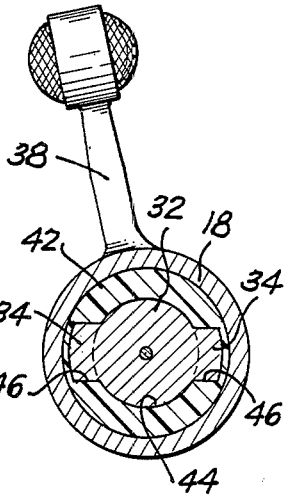
FIG. 4 is a cross-sectional view taken along line 3—3 in FIG. 2, showing the bolt rotated into its unlocked position.

Actuating handle 38 extends radially from elongated portion 32 and provides the operator with means to open, close, lock and unlock the bolt 30. When bolt 30 is in its closed, but unlocked position, handle 38 is oriented generally in the position shown in FIG. 4. In this position, locking lugs 34 are still in alignment with locking lug grooves 22. In order to lock the bolt in its closed position, handle 38 and elongated portion 32 are rotated in the downward direction of arrow 40 to the position shown in FIG. 3. This serves to rotate locking lugs 34 within annular recess 26, thereby moving them out of alignment with the locking lug grooves 22. This prevents any movement of the bolt 30, including posterior sliding movement of the bolt 30 with respect to receiver 18 in the direction of arrow 36.

Figure 5:
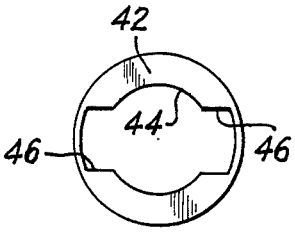
FIG. 5 is a plan view of the locking lug insert according to the invention.
Figure 6:
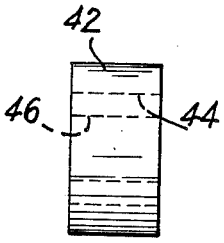
FIG. 6 is a side view of the locking lug insert shown in FIG. 5.

The locking lug insert according to the invention is illustrated in FIGS. 5 and 6 and comprises an insert body 42 defining a central aperture 44 and a pair of oppositely disposed, locking lug cut-outs 46 which open into central aperture 44. The number and location of cut-outs 46 should correspond to the number and location of locking lugs and locking lug grooves. Cut-outs 46 are sized and shaped to conform to the size and shape of the elongated locking grooves 22 and have sufficient clearance to accept locking lugs 34 therein. Insert body 42 is mounted in annular locking lug recess 26 such that the insert may rotate therein. The cut-outs 46 are normally aligned with elongated locking lug grooves 22 such that, when bolt 30 is moved into its closed position, locking lugs 34 enter the cut-outs 46. When bolt 30 is rotated into its locked position, the interengagement of the lugs 34 with the cut-outs 46 causes insert body 42 to rotate within an annular locking recess 26.

The presence of the body 42 and its rotational movement within annular recess 26 keeps the recess free of any debris which may ordinarily accumulate over the period of usage of the firearm. This maintains the ease of operation of moving the bolt between its locked and unlocked positions. Additionally, the small clearance between the inner surface of body 42 and the end of bolt 30 prevents the rearward escape of gasses should a cartridge rupture during firing.

The insert may be fabricated from various materials, such as a plastic or metal. It is envisioned that the insert will be fabricated from nylon, steel and nylon, carbamite, etc.

The positioning of the insert adjacent the end of the firearm barrel will also provide an additional damping for barrel vibrations, and will protect the tip of the bullet from any deformation as it advances from the receiver into the barrel firing chamber. The insert also provides additional locking lug surface area in contact with the threaded end of the barrel.

The foregoing is provided for illustrative purposes only and should not be construed as in any way limiting this invention, the scope of which is defined solely by the appended claims.

I claim:

1. A locking lug insert for a locking lug recess of a firearm receiver comprising an insert body havng an outer diameter dimensioned to be received in the locking lug recess so as to rotate therein without undergoing substantial translational movement, the body defining a non-threaded, smooth surfaced central aperture extending substantially the length of the body, and at least one locking lug cut-out extending substantially the length of the body and opening into the central aperture to accept a locking lug of a bolt associated with the receiver such that, as the bolt is rotated between its locked and unlocked positions, the insert body rotates within the locking lug recess without undergoing substantial translational movement.

2. The locking lug insert according to claim 1 wherein the insert body defines a pair of locking lug cut-outs opening into opposite sides of the central aperture.

3. The locking lug insert according to claim 1 wherein the body is formed of a plastic material.

4. The locking lug insert according to claim 3 wherein the body is formed of nylon.

5. The locking lug insert according to claim 3 wherein the plastic material is impregnated with a friction reducing substance.

6. The locking lug insert according to claim 5 wherein the friction reducing substance is Teflon.

7. The locking lug insert according to claim 5 wherein the friction reducing substance is graphite.

8. In a receiver for a firearm having an elongated chamber with a longitudinal axis, at least one logitudinal locking lug groove extending along and opening into the elongated chamber, and an annular locking lug recess extending around and opening into the elongated chamber, the improvement comprising a locking lug insert received in the locking lug recess and dimensoned so as to be capable of rotation within the locking lug recess without undergoing substantial translational movement therein, the insert defining a non-threaded, smooth surfaces central aperture aligned with the elongated chamber and extending substantially along the length of the insert and at least one locking lug cut-out opening into the central aperture and extending substantially along the length of the insert.

9. The receiver according to claim 8 wherein the locking lug insert defines a pair of locking lug cut-outs opening into opposite sides of the central aperture.

10. The receiver according to claim 8 wherein the locking lug insert is formed of a plastic material.

11. The receiver according to claim 10 wherein the locking lug insert is formed of nylon.

12. The receiver according to claim 10 wherein the plastic material is impregnated with a frition reducing substance.

13. The receiver according to claim 12 wherein the friction reducing substance is Teflon.

14. The receiver according to claim 12 wherein the friction reducing substance is graphite.

15. The receiver according to claim 8 wherein the transverse dimensions of the central aperture are substantially equal to the transverse dimensons of the elongated chamber.

16. In a bolt action for a firearm having a receiver defining an elongated chamber, at least one elongated locking lug groove extending along and opening into the chamber, and an annular locking lug recess extending around and opening into the elongated chamber; and a bolt mounted in the receiver having at least one locking lug extending therefrom adjacent an end slidably received in the at least one locking lug groove to allow the bolt to translate with respect to the receiver between open and closed positions, the locking lug entering the locking lug recess when the bolt is in the closed position thereby allowing the bolt to rotate with respect to the receiver such that the at least one locking lug is out of alignment with the at least one locking lug groove, the improvement comprising a locking lug insert mounted in the annular locking lug recess and dimensioned so as to rotate within the recess without undergoing substantial translational movement, the insert defining a non-threaded, smooth surfaces central aperture aligned with the elongated chamber and extending substantially the length of the insert and at least one locking lug cut-out opening into the central aperture and adapted to receive the locking lug when the bolt is in the closed position, the locking lug causing the insert to rotate with the bolt without undergoing substantial translational movement.

17. The bolt action according to claim 16 wherein the locking lug insert is formed of plastic material.

18. The bolt action according to claim 17 wherein the locking lug insert is formed of nylon.

19. The bolt action according to claim 17 wherein the plastic material is impregnated with a friction reducing substance whereby the bolt may move relative to the receiver at low ambient temperatures without additional lubricant.

20. The bolt action according to claim 19 wherein the friction reducing substance is Teflon.

21. The bolt action according to claim 19 wherein the friction reducing substance is graphite.

22. The receiver according to claim 10 wherein the transverse dimensions of the central aperture are substantially equal to the transverse dimensions of the elongated chamber.

* * * * *